US005099168A

United States Patent [19]

Holten

[11] Patent Number: 5,099,168

[45] Date of Patent: Mar. 24, 1992

[54] ELECTRIC REFLECTOR LAMP

[75] Inventor: Petrus A. J. Holten, Weert, Netherlands

[73] Assignee: U.S. Philips Corporation, New York, N.Y.

[21] Appl. No.: 553,479

[22] Filed: Jul. 13, 1990

[30] Foreign Application Priority Data

Jul. 27, 1989 [NL] Netherlands ..... 8901946

[51] Int. Cl.[5] ..... H01J 5/16; H01K 1/32

[52] U.S. Cl. ..... 313/113; 313/114

[58] Field of Search ..... 313/113, 114

[56] References Cited

U.S. PATENT DOCUMENTS

| | | | |
|---|---|---|---|
| 2,059,033 | 10/1936 | Rivier | 313/114 X |
| 4,506,185 | 3/1985 | Giller et al. | 313/113 |
| 4,633,126 | 12/1986 | Giller et al. | 313/113 |
| 4,788,469 | 11/1988 | Holten | 313/113 |
| 4,803,394 | 2/1989 | Holten | 313/113 |

*Primary Examiner*—Palmer C. DeMeo

*Attorney, Agent, or Firm*—Robert J. Kraus

[57] ABSTRACT

The reflector lamp has a lamp vessel (1) whose second portion (7) and third portion (10) are mirror-coated. A light source (17) is positioned axially on either side of the greatest diameter (3). The lamp gives a light beam with a high luminous flux and a high luminous intensity in the beam centre.

2 Claims, 1 Drawing Sheet

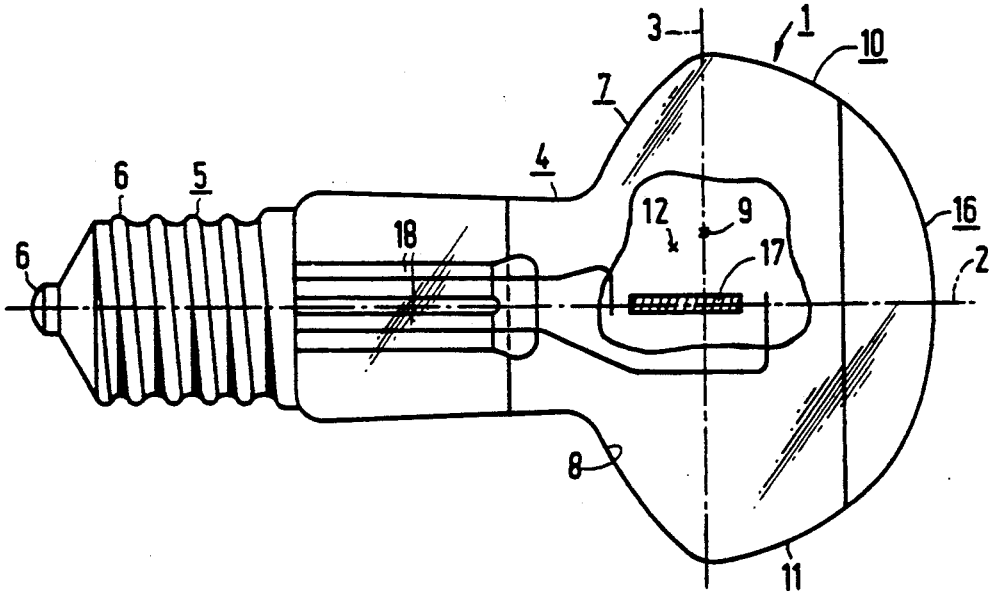
3
1
10
7
4
6
5
12
9
16
18
17
6
2
8
11

ELECTRIC REFLECTOR LAMP

BACKGROUND OF THE INVENTION

The invention relates to an electric reflector lamp provided with:

a rotationally symmetrical lamp vessel having an axis of symmetry and a greatest diameter transverse to said axis, a neck-shaped first portion behind the greatest diameter, which portion carries a lamp cap provided with contacts, a mirror-coated second portion which fluently merges into the first portion and extends towards the greatest diameter in a direction transverse to rather than longitudinally along the axis of symmetry, which second portion in axial cross-section is substantially curved according to a parabola branch having a focus, the axis of symmetry lying between the focus and the relevant parabola branch, a mirror-coated third portion which merges fluently into the second portion and extends in a direction longitudinally along rather than transverse to the axis of symmetry, which third portion in axial cross-section is substantially curved according to a circular arc having a centre of curvature, the axis of symmetry lying between the centre of curvature and the relevant circular arc and the centre of curvature lying in a region between the focus of the parabola branch and the first lamp vessel portion, opposite the neck-shaped first portion, a fourth portion adjoining the third portion, a light source arranged inside the lamp vessel, current supply conductors extending from the light source to the contacts at the lamp vessel.

Such a lamp is known from U.S. Pat. No. 4,803,394.

The lamp vessel of the known lamp has a shape which renders it suitable for being provided with various coatings in order to obtain a lamp which is suitable for one of various applications each time. An important application is that of a reflector lamp, which is obtained by providing the second and the third portion of the lamp vessel with a mirror coating. The object of this lamp is to provide a light beam with a high luminous flux and a high luminous intensity in the beam centre.

The lamp vessel of the known lamp was specifically designed for a helical incandescent body as the light source, which body is arranged transversely near the greatest diameter, bent around the axis of symmetry.

SUMMARY OF THE INVENTION

The invention has for its object to provide a reflector lamp of the kind described in the opening paragraph which achieves a light beam with a higher luminous flux and a higher luminous intensity in the beam centre.

According to the invention, this object is achieved by a lamp of the kind mentioned in the opening paragraph in that the light source is arranged axially and extends on either side of the greatest diameter.

Although the lamp vessel of the known lamp was specifically designed for incorporating an incandescent body in a plane transverse to the axis of symmetry through the foci of the parabola branches, at least coinciding partly with these foci, it was a surprise to find that a higher luminous flux in the beam and a higher luminous intensity in the beam centre are obtained when the light source is arranged axially, extending on either side of the greatest diameter. In addition, the light beam has a greater uniformity.

The axial position of the light source means that not only an incandescent body is suitable to form the light source, but also a high-pressure gas discharge, for example a high-pressure sodium vapour discharge, whose discharge path extends axially in the lamp vessel.

BRIEF DESCRIPTION OF THE DRAWING

An embodiment of the lamp according to the invention is shown in the drawing in side elevation.

DESCRIPTION OF THE PREFERRED EMBODIMENT

In the figure, the lamp has a rotationally symmetrical lamp vessel 1 with an axis of symmetry 2 and a greatest diameter 3 transverse to this axis. The lamp vessel has a neck-shaped first portion behind the greatest diameter 3, which carries a lamp cap 5 provided with contacts 6. A mirror-coated second portion 7, which merges fluently into the first portion 4 and extends towards the greatest diameter 3 in a direction transverse to rather than longitudinally along the axis 2, is in axial cross-section substantially curved according to a parabola branch 8 having a focus 9. The axis of symmetry 2 lies between the parabola branch 8 and its focus 9. A mirror-coated third portion 10, which merges fluently into the second portion 7 and extends in a direction longitudinally along rather than transverse to the axis 2, is in axial cross-section substantially curved as a circular arc 11 having a centre of curvature 12. The axis of symmetry 2 lies between the relevant circular arc 11 and the centre of curvature 12. The centre of curvature 12 lies in a region between the focus 9 of the parabola branch 8 and the first lamp vessel portion 4. Opposite the neck-shaped portion 4 the lamp vessel 1 has a fourth portion 16 which adjoins the third lamp vessel portion 10. A light source 17 is arranged inside the lamp vessel 1 and current supply conductors 18 extend therefrom to contacts 6 at the lamp cap 5.

The light source 17, an incandescent body in the drawing, is positioned axially in the lamp vessel 1 and extends on either side of the greatest diameter.

I claim:

1. An electric reflector lamp for producing a light beam having a high central luminous intensity, said lamp comprising an envelope formed around a longitudinal axis of symmetry and including:

a. a neck shaped first portion of the envelope supporting a lamp cap having a plurality of electrical contacts;

b. a reflectively coated second portion of the envelope extending from the first portion to a region where the envelope has a maximum diameter, said second portion extending substantially transversely from the axis and, in axial cross section, defining a substantially parabolic first arc having a center of curvature disposed at a position which, with respect to said first arc, is on the opposite side of the axis;

c. a reflectively coated third portion of the envelope extending from the second portion substantially longitudinally and, in axial cross section, defining a substantially circular second arc having a center of curvature disposed at a position which is closer to the first portion than the center of curvature of the first arc and, with respect to said second arc, is on the opposite side of the axis;

d. a light transmissive fourth portion of the envelope extending from the third portion to the axis; and e. a light source arranged around the axis of symmetry and extending into both the second and third portions of the envelope, said light source being electrically connected to the electrical contacts of the lamp cap.

2. An electric reflector lamp as in claim 1 where the center of curvature of the second arc is axially disposed at the region where the envelope has the maximum diameter.

* * * * *